US006233952B1

(12) United States Patent
Porter et al.

(10) Patent No.: US 6,233,952 B1
(45) Date of Patent: May 22, 2001

(54) PRETRIP ROUTINE COMPRISING OF INDIVIDUAL REFRIGERATION SYSTEM COMPONENTS

(75) Inventors: Kevin J. Porter; Peter H. Kopp, both of Syracuse; Garret J. Malone, East Syracuse; Mark B. Rabbia, Brewerton; Thomas J. Dobmeier, Baldwinsville, all of NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/234,037

(22) Filed: Jan. 19, 1999

(51) Int. Cl.[7] ..... F25B 49/02
(52) U.S. Cl. ..... 62/127; 62/131
(58) Field of Search ..... 62/125, 126, 127, 62/128, 129, 130, 131

(56) References Cited

U.S. PATENT DOCUMENTS 4,211,089 * 7/1980 Mueller et al. ..... 62/126 X
4,852,361 * 8/1989 Oike ..... 62/131
5,140,825 8/1992 Hanson et al. ..... 62/89
5,172,561 12/1992 Hanson et al. ..... 62/127
5,363,667 * 11/1994 Janke et al. ..... 62/131
5,579,648 * 12/1996 Hanson et al. ..... 62/126

* cited by examiner

*Primary Examiner*—Harry B. Tanner
(74) *Attorney, Agent, or Firm*—Wall Marjama & Bilinski

(57) ABSTRACT

The present invention is a pretrip routine for testing a refrigeration system comprising a series of tests for testing aspects of mechanical operation of various individual components of the refrigeration system. In a preferred embodiment, a control unit executes the method of the invention by first testing mechanical operation of a refrigeration system compressor, then tests for leaks in high-to-low-side valves of a refrigeration system, before testing for leaks in a discharge test valve. A control unit may also test the opening/closing operation of various refrigeration system valves before, intermediate or subsequent to executing the above tests. The pretrip routine of the invention validates operation of a refrigeration system as a whole by testing the mechanical operation of individual system component, and, in testing the operation of those various system components, readily isolates the source of a particular problem within a particular component of a refrigeration system.

17 Claims, 3 Drawing Sheets

PRETRIP ROUTINE COMPRISING OF INDIVIDUAL REFRIGERATION SYSTEM COMPONENTS

FIELD OF THE INVENTION

The present invention relates to refrigeration systems in general, and, in particular, to a pretrip routine for testing a refrigeration system prior to operating a refrigeration system in a cooling or heating/defrost mode of operation.

BACKGROUND OF THE PRIOR ART

A pretrip routine for testing a refrigeration system described in U.S. Pat. No. 5,172,561 operates by controlling system components first according to a cooling mode scheme, and then according to a heating/defrost mode scheme. During each of the simulated cooling and heat/defrost modes, a control unit monitors an air-aide temperature differential of a refrigeration system evaporator. If the evaporator air side temperature differential is within a range of temperature differentials indicative of the refrigeration system operating properly in each of the simulated cooling and heating/defrost modes, then the refrigeration system is determined to be operational.

The approach described in U.S. Pat. No. 5,172,561 suffers from two major limitations. The first limitation is that the approach is susceptible to false failures. Under certain operating conditions, the evaporator temperature differential will be outside of a range of temperature differential indicative of proper operation in spite of the system being fully operational. Evaporator temperature is likely to be outside of a range indicative of proper operation particularly under extremely humid work space conditions.

The second major limitation of the approach described in U.S. Pat. No. 5,172,561 is that the approach cannot isolate problems within particular refrigeration system components. When a refrigeration system failure is indicated, the system provides only a general alarm that problem exists somewhere in the system, and cannot identify which particular components in the system have failed. Fixing problems pursuant to a general alarm may require inspection of each of several system components.

There is a need for a refrigeration system pretrip routine which is not susceptible to false failures and which can isolate particular problems within a refrigeration system.

SUMMARY OF THE INVENTION

According to its major aspects and broadly stated, the present invention is a pretrip routine for testing a refrigeration system comprising a series of tests for testing aspects of mechanical operation of various individual components of the refrigeration system. The pretrip routine of the invention validates operation of a refrigeration system as a whole by testing the mechanical operation of individual system components, and, in testing the operation of those various system components, readily isolates particular problems within particular components of a refrigeration system.

In a preferred embodiment, a control unit executes the method of the invention by first testing mechanical operation of a refrigeration system compressor, then tests for leaks in high-to-low-side valves of a refrigeration system, before testing for leaks in a discharge test valve. A control unit may also test the opening/closing operation of various refrigeration system valves before, intermediate or subsequent to executing the above tests. In a compressor operation test, a control unit may check loading/unloading operation of a compressor by changing the loading state of a compressor and monitoring for changes in a discharge pressure differential indicator. In a leak test, a control unit may shut a compressor engine off and monitor for changes in a discharge pressure differential indicator. A control unit may test the opening/closing operation of a refrigeration system valve by changing the state of a valve and monitors for changes in a differential pressure indicator subsequent to the state change.

These and other details, advantages and benefits of the present invention will become apparent from the detailed description of the preferred embodiment hereinbelow.

BRIEF DESCRIPTION OF THE DRAWINGS

For a fuller understanding of the nature and objects of the invention, reference should be made to the following detailed description of a preferred mode of practicing the invention, read in connection with the accompanying drawings, in which.

DETAILED DESCRIPTION OF THE INVENTION

Figure 1:
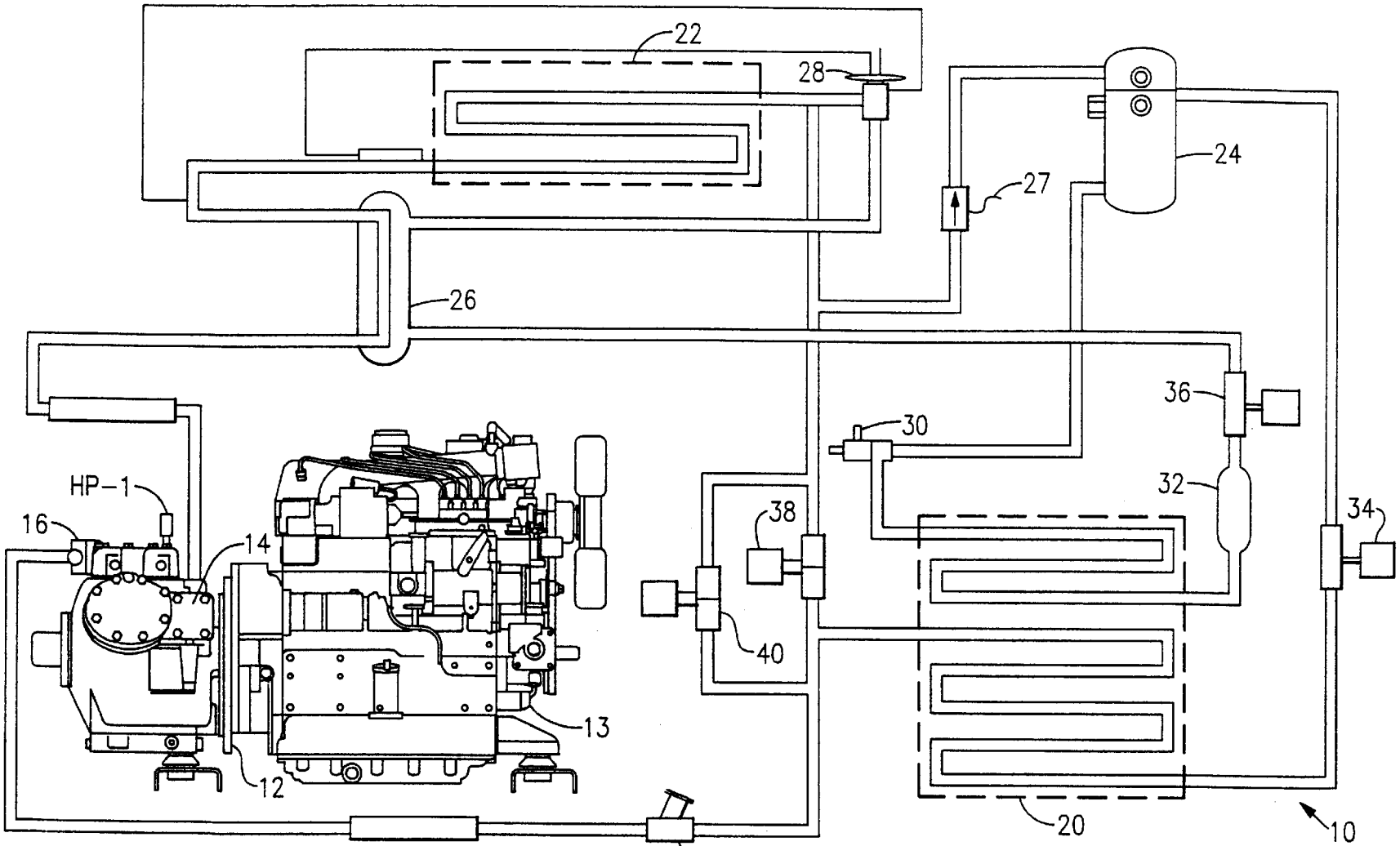
FIG. 1 is a block diagram of an exemplary refrigeration system in which the invention may be incorporated.

One particular example of a refrigeration system in which the present invention may be employed is shown in FIG. 1. Refrigeration system 10 includes a compressor 12 driven by an engine 13, a suction service valve 14, a discharge service valve 16, a discharge check valve 18, an air cooled condenser 20 which includes a subcooler portion, an evaporator 22, a receiver 24, a heat exchanger 26, a bypass check valve 27, an expansion valve 28, a manual receiver shutoff valve 30, a filter drier 32, a plurality of valves 34, 36, 38, 40 (typically provided by solenoid valves), a front and rear unloader (not shown), a speed control solenoid 45 (FIG. 2), and an evaporator fan clutch (not shown). Compressor 12 includes a discharge or "high" side 15 and a suction, or "low" side 17. By convention, components of system 10 located toward high side 15 including discharge check valve 18 and condenser 20 are termed "high side" system components whereas system components located toward low side 15 including evaporator 22 and expansion valve 28 are termed "low side" system components. Furthermore, the region of system 10 between discharge side 15 and condenser 20 is conveniently referred to as the "high side" or "high pressure side" of system 10, while the region of system between condenser 20 and suction side 17 is conveniently referred to as the "low side" or "low pressure side" of system 10. Because valves 34–40 all operate to control the flow of refrigerant between high and low side system components, they are sometimes referred to herein as high to low side valves. The refrigeration system 10 operates in various modes, including a cooling mode and a heating/defrost mode. In the cooling mode, the refrigeration system 10 removes heat from a work space. In the heating mode, the refrigeration system 10 adds heat to the work space. In the defrosting mode, the refrigeration system adds energy to the evaporator, where the evaporator fan clutch is off, thus defrosting the evaporator.

Preliminarily, note that any known refrigerant may be used in the system, and that all references made to gas or liquid herein are actually referring to the state of the refrigerant at different places during operation. Generally, the purpose of the refrigerant is to pick up heat by evaporating at low pressure and temperature, and to give up heat by condensing at high temperature and pressure. For instance, by manipulating the pressure of the refrigerant to appropriate levels, the same refrigerant can evaporate at 40 degrees F and condense at 120 degrees F. By evaporating at a low temperature, heat will flow from the work space into the refrigerant within the direct expansion evaporator 22. Conversely, the refrigerant rejects heat when it condenses from a gas into a liquid. This process is explained in greater detail below.

Operation of the refrigeration system 10 in a cooling mode of operation or a cooling cycle is as follows. In general, during the cooling cycle the evaporator 22 draws heat from the work space being cooled, whereas the condenser 20 is used to reject heat from the high pressure gas to the external environment.

To initiate a cooling cycle, a reciprocating compressor 12 receives low pressure refrigerant in the form of super-heated gas through a suction service valve 14 and compresses the gas to produce a high-pressure, super-heated gas. By reducing the volume of the gas, the compressor 12 establishes a high saturation temperature which enables heat to flow out of the condenser. The high pressure gas is discharged from the compressor 12 through a discharge service valve 16 and flows through a discharge check valve 18 into the condenser 20.

Next, a fan in the condenser 20 circulates surrounding air over the outside of condenser tubes comprising the coil. This coil is where the condensation takes place, and heat is transferred from the refrigerant gas to the air. By cooling the gas as it passes through the condenser 20, the removal of heat causes the gas to change state into a high-pressure saturated liquid. The refrigerant leaves the condenser as a high-pressure saturated liquid, and flows through valve 34, conveniently referred to as "condenser valve", into the receiver 24. As is shown in FIG. 1, valves 38 and 40, conveniently referred to as "hot gas valves", are closed thereby keeping the discharged gas from entering into a direct expansion evaporator 22.

From the air-cooled condenser 20, the high-pressure liquid then passes through open condenser valve 34 (sometimes referred to herein as condenser pressure control valve 34) and into a receiver 24. The receiver 24 stores the additional charge necessary for low ambient operation in a heating mode. The receiver 24 is equipped with a fusible plug which melts if the refrigerant temperature is abnormally high and releases the refrigerant charge. At the receiver 24, any gas remaining in the high-pressure liquid is separated and the liquid refrigerant then passes back through the manual receiver shutoff valve 30 (king valve) and into a subcooler section of the condenser 20 where it is subcooled. The subcooler occupies a portion of the main condensing coil surface and gives off further heat to the passing air. After being subcooled the liquid then flows through the filter-drier 32 where an absorbent keeps the refrigerant clean and dry. The high-pressure liquid then passes through the electrically controlled valve 36, conveniently referred to as "liquid line valve", which starts or stops the flow of refrigerant. In addition, the high-pressure liquid may flow to a heat exchanger 26. If so, the liquid is cooled even further by giving off some of its heat to the suction gas.

Next, the cooled liquid emerging from the heat exchanger 26 passes through an externally equalized thermostatic expansion valve 28. As the liquid is metered through the valve 28, the pressure of the liquid drops, thus allowing maximum use of the evaporator heat transfer surface. More specifically, this expansion valve 28 takes the subcooled liquid, and drops the pressure and temperature of the liquid to regulate flow to the direct expansion evaporator 22. This results in a low pressure saturated liquid/gas mixture.

After passing through the expansion valve 28, the liquid enters the direct expansion evaporator 22 and draws heat from the work space being cooled. The low pressure, low temperature fluid that flows into the evaporator tubes is colder than the air that is circulated over the evaporator tubes by the evaporator fan. As a result, heat is removed from the air circulated over the evaporator 22. That is, heat from the work space is transferred to the low pressure liquid thereby causing the liquid to vaporize into a low-pressure gas, thus, and the heat content of the air flowing over the evaporator 22 is reduced. Thus, the work space experiences a net cooling effect, as colder air is circulated throughout the work space to maintain the desired temperature. Optionally, the low-pressure gas may pass through the "suction line/liquid line" heat exchanger 26 where it absorbs even more heat from the high pressure/high temperature liquid and then returns to the compressor 12.

After passing through the heat exchanger 26, the gas enters the compressor 12 through the suction service valve 14 where the process repeats itself. That is, the air cooled by the evaporator 22 is sent directly to the air conditioned work space to absorb more heat and to bring it back to the coil for further cooling.

The refrigeration system of the present invention may also be used to heat the work space or defrost the evaporator 22. During the heating/defrost cycle, a low pressure vapor is compressed into a high pressure vapor, by transferring mechanical energy from a reciprocating compressor 12 to the gas refrigerant as it is being compressed. This energy is referred to as the "heat of compression", and is used as the source of heat during the heating/defrost cycle. This refrigeration system is known as a "hot gas heat" type refrigeration system since the hot gas from the compressor is used as the heat source for the evaporator. By contrast, the present invention could also be employed with heat pumps wherein the cycle is reversed such that the heat normally rejected to the ambient air is rejected into the work space. The heating/defrost cycle will now be described in detail.

In the heating/defrost cycle, the reciprocating compressor 12 receives low pressure and low temperature gas through the suction service valve 14 and compresses the gas to produce a high pressure gas. The high temperature, high pressure gas is discharged from the compressor 12 through the discharge service valve 16. The hot gas valve 38 and the condenser pressure valve 34 are closed to prevent refrigerant from flowing through them. This closes off the condenser 20 so that once the condenser coils are substantially filled with refrigerant, the majority of the refrigerant will then flow through the discharge check valve 18 and the hot gas valve 40. The hot gas from the compressor 12 then flows into the evaporator 22, effectively transferring energy from the compressor to the evaporator and then to the work space.

A processor 100 opens valve 36 when the compressor discharge pressure falls to cut-in settings, allowing refrigerant from the receiver to enter the evaporator 22 through the expansion valve 28. The hot vapor flowing through valve 40 forces the liquid from the receiver 24 via a bypass check line and a bypass check valve 27. By opening valve 36 and closing valve 34, the refrigerant liquid is allowed to fill up and build up head pressure, equivalent to discharge pressure, in the condenser 20. Opening valve 36 also allows additional refrigerant to be metered through the expansion valve 28 so that it eventually is disposed in the condenser 20. The increase of the refrigerant in the condenser 20 causes the discharge pressure to rise, thereby increasing the heating capacity of the refrigeration system 10. This allows the compressor 12 to raise its suction pressure, which allows the refrigeration system 10 to heat. Liquid line valve 36 will remain open until the compressor discharge pressure increases to cut-out setting, at which point a processor 100 closes (shown in FIG. 2) solenoid valve 36. This stops the flow of refrigerant in the receiver 24 to the expansion valve 28. Significantly, valve 36 may be closed only after the compressor 12 is discharging at a cut-out pressure. Thus, via the evaporator 22, the high pressure refrigerant gas gives off heat to the work space, lowering the temperature of the refrigerant gas. The refrigerant gas then leaves the evaporator 22 and flows back to the compressor 12 through the suction service valve 14.

In a preferred embodiment, the hot gas valve 38 is closed if the ambient temperature is above a first predetermined temperature. If after a 60 second delay the engine remains in high speed, and the difference between ambient and discharge temperatures exceeds a pre-determined temperature differential, then valve 38 opens. On the other hand, if the difference between ambient and discharge temperatures goes below a second pre-determined temperature differential, then valve 38 closes. When in engine operation and the discharge pressure exceeds pre-determined pressure settings, pressure cutout switch (HP-1) opens to de-energize the run relay coil and stop the engine.

Figure 2:
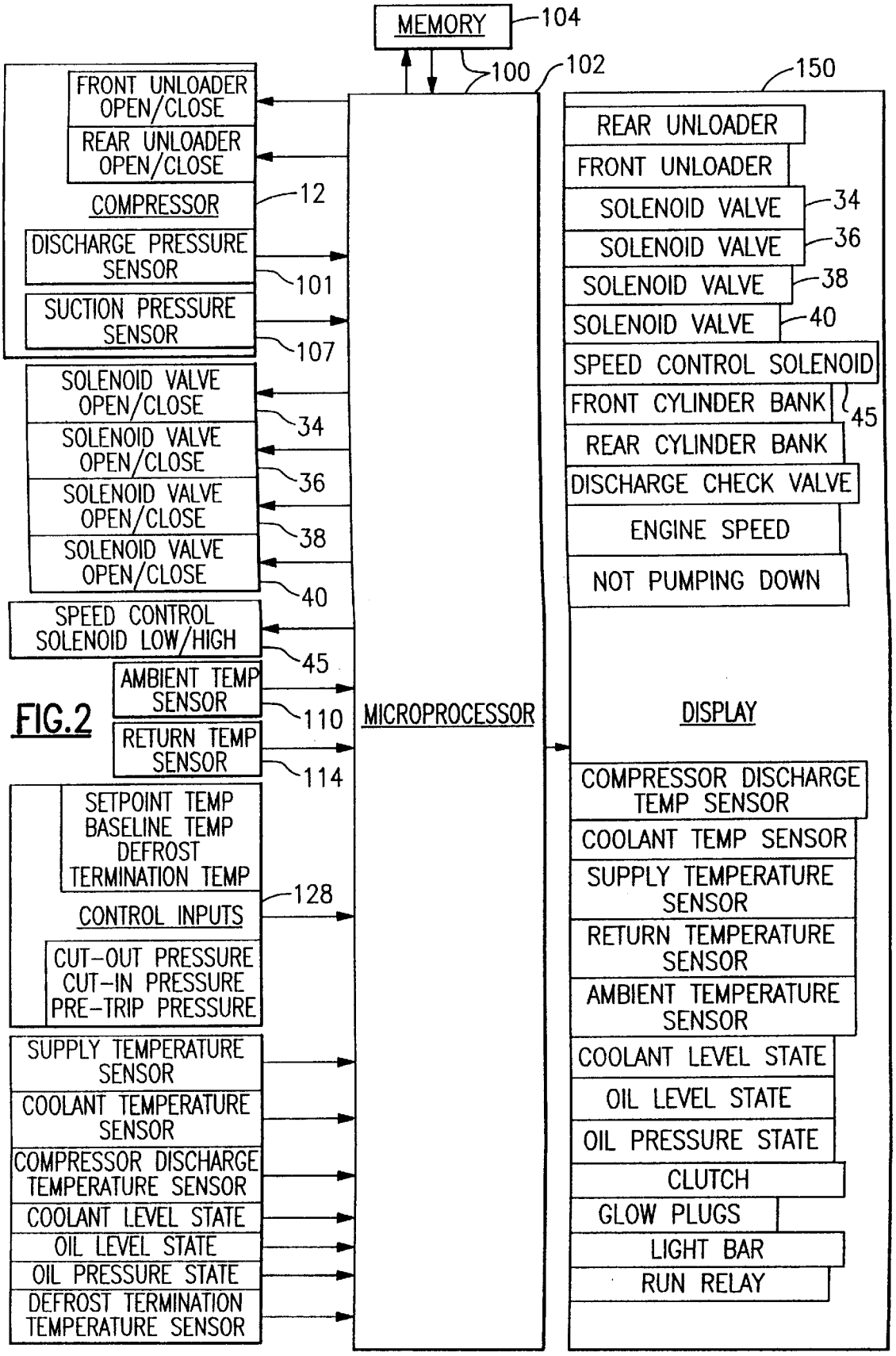
FIG. 2 is a block diagram of a control system including a control unit for operating a refrigeration system in a cooling, heat/defrost mode, or a pretrip mode of operation.

Turning to FIG. 2, the refrigeration system 10 is electronically controlled by a control unit shown as being provided by a processor 100, including a microprocessor 102 and an associated memory 104. The processor 100 is connected to a display 150 which displays various parameters and also various fault alarms that exist within the refrigeration system 10.

When the refrigeration system 10 is in an operating mode to control the temperature of a work space, the processor 100 receives several inputs including an ambient temperature from an ambient temperature sensor 110, a setpoint temperature, a return temperature from a return temperature sensor 114, a baseline temperature, a suction pressure from a suction pressure transducer 107, a discharge pressure from a discharge pressure transducer 101, a cut-out pressure, a cut-in pressure and a pretrip pressure. The ambient temperature is received by the processor 100 through the ambient temperature sensor 110 on the exterior of the work space. The setpoint temperature is input to the processor 100 through an input control device 128 and is typically the desired temperature of the work space. The return temperature is the actual temperature of the work space and is received by the processor 100 through the return temperature sensor 114 located within the work space. The baseline temperature is input to the processor 100 through the input control device 128 and will be discussed later.

In addition, there are several other inputs to the processor 100 including a supply temperature, a coolant temperature, a compressor discharge temperature, a coolant level state, an oil level state, an oil pressure state, and a defrost termination temperature.

The suction pressure, sensed by the suction pressure transducer 107, is the pressure of the refrigerant vapor at the low side of the compressor 12 as it is being drawn into the compressor through the suction service valve 14. The suction pressure transducer 107 is disposed in a position to monitor the pressure through the suction service valve 14 and the suction pressure value is input to the processor 100, where the processor 100 uses the value or stores the value for later use.

The discharge pressure, sensed by the discharge pressure transducer 101, is the pressure at the high side of the compressor 12. This is the pressure of the refrigerant vapor as it is being discharged from the compressor 12 through the discharge service valve 16. The discharge pressure is monitored by a pressure transducer 101 disposed in a position to monitor the pressure through the discharge service valve 16 and the discharge pressure value is input to the processor 100, where the processor 100 uses the value or stores the value for later use.

At certain times during operation of refrigeration system 10 in an operational mode, such as a cooling, a heat/defrost mode, or a pretrip mode, it may be necessary to control an input to a system component based on a pressure differential indicator which indicates a pressure differential between different points in a refrigeration system such as between a high side and a low side of compressor 12. Because discharge pressure, suction pressure, and pressure differential normally predictably depend on one another, this pressure differential indicator can in general, be provided by any one of a discharge pressure reading, a suction pressure reading or pressure differential such as (discharge pressure minus suction pressure) reading or by a combination of such readings. Furthermore, because pressure is related to temperature, a pressure differential indicator can also normally be provided by a discharge temperature reading, a suction temperature reading, or temperature differential such as (discharge temperature minus suction air temperature) reading or by a combination of such readings. Under certain circumstances, however, such as where the refrigerant is subjected to temperature sensing in a vapor-only phase, a temperature transducer may not provide as reliable an indicator as pressure as a pressure transducer.

The cut-out pressure, cut-in pressure and pretrip pressure are user selected pressure values that are input to the processor 100 through the input control device 128 and will be discussed below.

The processor 100 determines whether to operate refrigeration system 10 in a cooling mode or heating mode by comparing the setpoint temperature to the supply and/or return temperature. If the setpoint temperature is less than the return temperature, then processor 100 operates the refrigeration system 10 in a cooling mode. If the setpoint temperature is greater than the return temperature, then processor 100 operates refrigeration system 10 in a heating mode.

In the cooling mode, the processor 100 opens and closes high-to-low side valves 34–40 according to a required protocol as described previously herein in connection with FIG. 1. In particular, the processor 100 opens valves 34 and 36 and closes valves 38 and 40, which forces the refrigerant to flow from the compressor 12 to the condenser 20, through the condenser 20 and to the receiver 24, through the receiver 24 and back to the condenser 20, through the condenser 20 and to the heat exchanger 26, through the heat exchanger 26 and through the expansion valve 28 and then to the evaporator 22, through the evaporator 22 and back through the heat exchanger 26, and then back to the compressor 12. The details of the cooling mode have been discussed above.

In the heating mode, the processor 100 opens and closes high-to-low side valves 34–40 according to a required protocol and as described previously according to FIG. 1. In particular, the processor 100 closes condenser valve 34 and opens hot gas valve 40, which causes the condenser 20 to fill with refrigerant, and forces the hot gas from the compressor 12 into the evaporator 22. The liquid line valve 36 remains open until the discharge pressure reaches the cut-out pressure, at which point the processor 100 de-energizes and closes the liquid line valve 36 thereby stopping the flow of refrigerant into the expansion valve 28. When the compressor discharge pressure falls to the cut-in pressure, the processor 100 in turn energizes the closed liquid line valve 36 which opens, allowing refrigerant from the receiver 24 to enter the evaporator 22 through the expansion valve 28. Typically, in the heating mode, valve 38 remains closed until the compressor discharge temperature rises by a predetermined amount at which point valve 38 opens. The details of the heating mode have been discussed above. From time to time, the refrigeration system 10 will be caused to cease operating in a cooling or heating/defrost mode. For example, refrigeration system 10 is employed to control the air temperature of a tractor trailer work space (known as a "box") it is typical to take the refrigeration system 10 out of a cooling or heating/defrost mode when a door of the trailer is opened for loading or unloading goods from the box. Before starting up the refrigeration system 10, or restarting the system 10 after a temporary shutdown, it is sometimes desirable to have the processor 100 execute a routine in order to determine the operational condition of various components of the refrigeration system 10. Because such a routine is useful in determining component problems which may cause the refrigeration system 10 to malfunction when placed on-line (that is, caused to operate in a cooling or heat/defrost mode), such a routine may be referred to as a "pretrip" routine.

Preferably, the pre-trip routine comprises several tests for determining the mechanical operation of each of several system components such as high-to-low side valves 34, 36, 38, 40, the discharge check valve 18, a front unloader, a rear unloader, a front cylinder bank and a rear cylinder bank (not shown) of the compressor 12.

Now referring to specific aspects of the present invention, the present invention relates to a method for executing a pretrip routine which includes provisions for mechanical operation testing of various individual system components. In a preferred embodiment, processor 100 in execution of the pretrip routine of the present invention individually tests, with a series of separately administered tests, the mechanical operation of several system components including: Compressor 12, each high-to-low side valve 34, 36, 38, 40, and discharge check valve 18. In the preferred embodiment, processor 12 executes more than one test for testing certain system components. For example, as will be explained herein, processor 100 may execute a first test for testing front unloaders of a compressors, a second test for testing rear unloaders of a compressor and a third test for testing the cylinder banks of compressor 12. Furthermore, processor 100 may execute a first test for testing the opening and closing operation of a system valve, e.g. condenser valve 34, and a second test for testing the leak status (ie whether the valve is leaking) of a valve or one of a group of valves. The method of the invention is in contrast with the pretrip method discussed in the background herein in which the operation of a refrigeration system in a pretrip routine is tested for essentially by analysis of a single parameter, evaporator temperature. This prior art method is susceptible to false failures and furthermore fails to isolate problems within specific components of a refrigeration system 10. The method of the present invention can confirm overall operation of a refrigeration system while isolating particular problems within specific refrigeration components.

Figure 3:
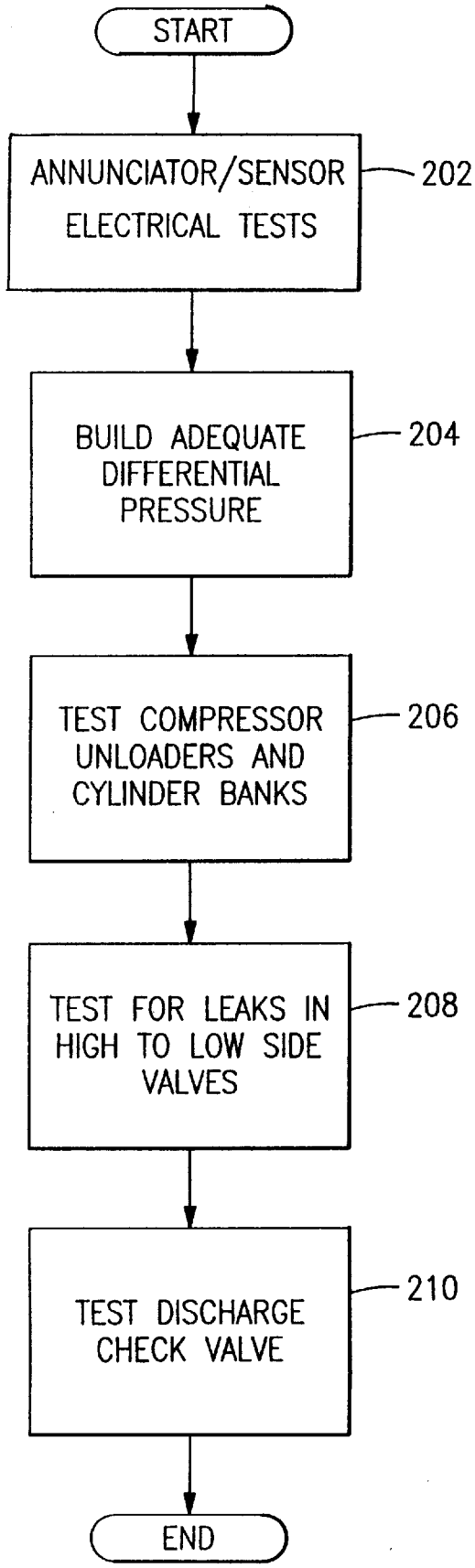
FIG. 3 is a flow diagram illustrating operational steps which may be carried out by a control unit in one example of the invention.

A specific example of the present invention which may be implemented for testing of the particular refrigeration system of FIG. 1 is described with reference to the flow diagram of FIG. 3. Operation of the exemplary method of the invention is as follows:

Before directly testing mechanical operational aspects of various system components, processor 100 preliminarily conducts an electrical system check. In an electrical system check, processor 100 determines whether the annunciators of display 150 of system, valves 34, 36, 38, 40, and sensors e.g. 110, 114 are being supplied with electrical power. In conducting this test, processor 100 checks for current flow through various annunciators, sensors and other components requiring electrical power for operation. At block 202, processor may determine whether electrical power is being supplied to or is available to for example, LED's, annunciators including audio annunciators, and a display associated with processor 100, components requiring electrical power for operation such as solenoid valves, glow plugs, a clutch, compressor unloaders, and to sensors such as temperature and temperature sensors having inputs received by processor 100.

When the electrical system check is complete, processor 100 proceeds to block 204 to impart appropriate control over various system component for the purpose of building a substantial differential or "head pressure" in system 10. Many of the component mechanical operations tests which follow the head pressure building step involve testing for leaks in a component of the system such as compressor or a valve 18, 34, 36, 38, 40. The differential head pressure should be sufficient to force refrigerant through a leak if a leak exists in a component part so that the leak can be detected.

In a preferred embodiment of the invention, the head pressure building step indicated by block 204 is executed so that the head pressure building step is carried out differently depending on ambient temperature. This is because differential pressure (sufficient to detect leaks) is generally easier to provide in warmer ambients. In warmer ambient conditions (e.g above 32 deg. F) a differential pressure sufficient to detect leaks in general can be achieved without closing condenser valve 34 and without increasing the capacity of compressor above 2 cylinder operation. In cooler ambients, it may be beneficial to take additional measures to build sufficient head pressure in system 10. For example, in cooler ambients (e.g. below about 32 deg. F) it may be beneficial to close condenser valve 34 or another high-to-low side valve in order to increase the pressure differential and it may further be beneficial to increase the capacity of compressor, for example, to 4 cylinder operation. This method of building head pressure differently depending on a determined system parameter is discussed in detail in copending application Ser. No. 09/234,032 entitled "Adaptive Pretrip Routine" assigned to the assignee of the present invention, filed concurrently herewith and incorporated herein in its entirety by reference. During execution of the step of building adequate differential pressure it may be convenient to test the opening/closing operation of certain high-to-low side valves, such as condenser valve 34 and liquid line valve 36. The opening/closing operation of a valve is verified, in general, but changing the state of the valve (that is opening it if closed and closing the valve if open) and observing the affect of such state changing on a differential pressure indicator (differential pressure, suction pressure, or discharge pressure). If changing the state of a valve does have a desirable impact on a differential pressure indicator as expected, then the opening/closing operation of the valve is verified. A test of the opening/closing operation of condenser valve 34 may be carried out during execution of the step of building adequate differential pressure by temporarily opening valve 34 while monitoring for changes in a differential pressure indicator, before closing the valve for execution of a subsequent test if the valve is to be closed during the subsequent test.

When processor 100 has completed the step of building adequate head pressure, processor 100 proceeds to block 206 in order to test mechanical operational aspects of compressor 12. In testing compressor 12, processor 100 may test the mechanical operation of the front and rear unloaders of compressors and the cylinder bank of compressor. In general processor 100 verifies the opening/closing operability of each of the unloaders by changing the state of the unloaders and monitoring for changes in a differential pressure indicator. At the end of the test of unloader operation, differential pressure indicator readings will have been made for the compressor in three distinct states: (1) The front unloader loaded and the rear unloader unloaded; (2) the front unloader unloaded and the rear unloader loaded; and (3) both of the front and rear unloaders unloaded. Based on a mathematical relationship between a differential pressure indicator in these three states, processor 100 can determine if a problem exists in one of the cylinder banks of compressor 12 and can isolate in which bank the problem exists. A more detailed explanation of a specific test for testing operation of a compressor of a refrigeration system is provided in patent application Ser. No. 09/234,041 entitled "Pretrip Device for Testing of a Refrigeration System Compressor" assigned to the assignee of the present invention, filed currently herewith and incorporated herein by reference in its entirety.

When processor 100 has completed the series of tests related to compressor operation, processor 100 may proceed to block 208 in order to execute a test to determine whether a leak exists in one of the system's high-to-low side valves 34, 36, 38, 40. In testing for a leak in one of the high-to-low side valves, processor 100 imparts appropriate control over system components in order to reduce suction pressure substantially below the expected work space saturation pressure of the refrigerant (typically by way of a routine that includes closing all high-to-low-side valves), shutting off compressor engine 13 and monitoring for changes in a differential pressure indicator. When compressor engine 13 is shut off, the pressure in system 10 between compressor 12 and discharge check valve 18 drops significantly as a result of cooling. Accordingly, when processor 100 utilizes discharge pressure as a pressure differential indicator to control operation of various system components after the engine has been shut off, it is preferred that processor 100 measure discharge pressure from a pressure transducer located downstream of discharge check valve 18 at the high pressure side of system 10, such as from a pressure transducer at condenser 20. Without any significant leaks in the high-to-low side valves, there should be little change in a differential pressure indicator when processor 100 shuts the compressor engine off. If processor 100 on the other hand observes a discernable change in a pressure differential indicator over time after the engine is shut off, processor determines that a leak exists in one of the high-to-low side valves. It can be seen that a leak in a valve may not be detected for if the suction pressure is approximately equal to or comparable to the work space saturation pressure correspond to a work space temperature prior to the engine being shut off. This is because if a leak does exists in one of the high to low side valves then the evaporator pressure will tend toward the saturation pressure over time. Thus, if the suction pressure at the time of engine shut off and the work space saturation pressure are not substantially different, then the change in suction pressure over time after the engine is shut off may not be sufficient to indicate that a leak exists.

In order to reduce suction pressure substantially below a work space saturation pressure to level sufficient to register a detection of a leak, it is preferred that processor execute a three pumpdown process, each pumpdown comprising the step of isolating the refrigeration system by closing all high to low side valves while continuing to operate compressor 12 in at least low capacity operation.

Testing of the opening/closing operation of hot gas valves 38, 40 is conveniently undertaken during this three pumpdown process. In particular, the opening and closing operation of hot gas valve 38 or hot gas valve 40 can be conveniently determined after a pumpdown by temporarily opening one of the valves 38, 40 and monitoring for a corresponding change in a differential pressure indicator. Methods for conducting a high-to-low side leak test in a refrigeration system are discussed in detail in a copending patent application Ser. No. 09/233,770 entitled "Test for the Automated Detection of Leaks Between a High and Low Pressure Side of a Refrigeration System" filed concurrently herewith, assigned to the assignee of the present invention and incorporated herein by reference in its entirety.

The high-to-low side leak test described above requires a high pressure differential. High pressure differences pose the risk of damage to refrigeration system component parts. Accordingly, when processor 100 administers the high-to-low side leak test described above, it is preferred that processor 100 contemporaneously administer a routine that has been developed by the assignee of the present invention for maintaining discharge pressure below a predetermined pressure. This routine is described in detail in copending application Ser. No. 09/233,775 entitled "Control Algorithm for Maintenance of Discharge Pressure" assigned to the assignee of the present invention, filed concurrently herewith and incorporated herein by reference in its entirety. Discharge pressure may be controlled by the opening and closing of condenser valve 34. A test for testing the opening/closing operating of condenser valve 34, in addition to being convenient to implement in a head pressure building step (block 204) is also convenient to implement just prior to initiating a routine for controlling discharge pressure, and prior to administering a routine for testing for high-to-low side leaks as indicated by block 208.

When processor 100 has completed the test for high-to-low side valve leaks in processor 100 may proceed to block 210 in order to test for leaks in discharge check valve. A test for a leak in discharge check valves may be carried out in general by isolating system 10 while compressor operates in at least low capacity operation, turning off the compressor engine, temporarily unloading the unloaders of the compressor to allow refrigerant to leak to the suction side, then monitoring for changes in discharge pressure over time after re-loading the unloaders. If there is no leak in the discharge pressure check valve, then in theory discharge pressure will not change substantially over time after the unloaders are re-loaded. A substantial change in discharge pressure over time after re-loading the unloaders indicates that refrigerant has passed through discharge check valve 18 and therefore, indicates a leak in the discharge check valve 18. Methods for conducting such a discharge check valve leak test are discussed in detail in copending application Ser. No. 09/234,029 entitled "Method for the Automated Detection of Leaks in a Discharge Check Valve" assigned to the assignee of the present invention, filed concurrently herewith and incorporated by reference herein in its entirety.

When processor has completed the mechanical operational testing of the designated system components then processor terminates the pretrip routine after executing block 210. If processor 100 executes the routine without determining any problems, then the refrigeration system 10 is determined to be ready for operation in an operational mode such as a cooling mode a heating mode or a defrost mode.

While this invention has been explained with reference to the structure disclosed herein, it is not confined to the details set forth and this invention is intended to cover any modifications and changes as may come within the scope of the following claims:

We claim:

1. A method for operating a refrigeration system, said method comprising the steps of:

prior to operating said refrigeration system in a cooling or heating/defrost mode, conducting a pretrip routine, said pretrip routine including the step of testing mechanical operation of a refrigeration system valve, wherein said refrigeration system valve testing step includes the steps of testing opening/closing operation of said refrigeration system valve and of testing for leaks in said refrigeration system valve; and subsequent to conducting said pretrip routine, operating said refrigeration system in a cooling or heating/defrost mode of operation.

2. The method of claim 1, wherein said pretrip routine includes the step of testing a high-to-low side valve of said refrigeration system.

3. The method of claim 1, wherein said pretrip routine further includes the step of testing mechanical operation of a refrigeration system compressor.

4. The method of claim 3, wherein said compressor test includes the step of testing operation of at least one cylinder bank of said compressor.

5. The method of claim 3, wherein said compressor test includes the step of testing the loading/unloading operation of at least one compressor unloader.

6. The method of claim 1, wherein said pretrip routine further includes the step of testing for leaks in a discharge check valve.

7. The method of claim 1, wherein said pretrip routine further includes the steps of testing mechanical operation of a compressor and of testing for leaks in a discharge check valve.

8. A method for operating a refrigeration system, said method comprising the steps of:

prior to operating said refrigeration system in a cooling or heating/defrost mode, conducting a pretrip routine, said pretrip routine including the step of testing mechanical operation of a refrigeration system compressor; and subsequent to conducting said pretrip routine, operating said refrigeration system in a cooling or heating/defrost mode of operation.

9. The method of claim 8, wherein said compressor test includes the step of testing operation of at least one cylinder bank of said compressor.

10. The method of claim 8, wherein said compressor test includes the step of testing the loading/unloading operation of at least one compressor unloader.

11. The method of claim 8, wherein said compressor test includes the step of testing operation of at least one cylinder bank of said compressor, and testing the loading/unloading operation of at least one compressor unloader.

12. The method of claim 8, wherein said pretrip routine further includes the step of testing for leaks in a discharge check valve.

13. The method of claim 8, wherein said pretrip routine further includes the steps of testing opening/closing operation of a refrigeration system high-to-low side valve and of testing for leaks in said refrigeration system high-to-low side valve.

14. A method for operating a refrigeration system, said method comprising the steps of:

prior to operating said refrigeration system in a cooling or heating/defrost mode, conducting a pretrip routine, said pretrip routine including the step of testing for leaks in a discharge check valve; and subsequent to conducting said pretrip routine, operating said refrigeration system in a cooling or heating/defrost mode of operation.

15. The method of claim 14, wherein said pretrip routine further comprises a compressor test that includes the step of testing operation of at least one cylinder bank of said compressor, and testing the loading/unloading operation of at least one compressor unloader.

16. The method of claim 14, wherein said pretrip routine further includes the steps of testing opening/closing operation of a refrigeration system high-to-low side valve and of testing for leaks in said refrigeration system high-to-low side valve.

17. The method of claim 14, wherein said pretrip routine further comprises a compressor test that includes the step of testing operation of at least one cylinder bank of said compressor, and testing the loading/unloading operation of at least one compressor unloader, and wherein said pretrip routine further includes the steps of testing opening/closing operation of a refrigeration system high-to-low side valve and of testing for leaks in said refrigeration system high-to-low side valve.

* * * * *